US009528483B2

(12) United States Patent
Harada

(10) Patent No.: US 9,528,483 B2
(45) Date of Patent: Dec. 27, 2016

(54) HIGH PRESSURE FUEL DELIVERY PIPE ASSEMBLY FOR DIRECT INJECTION OF FUEL

(71) Applicant: MARUYASU INDUSTRIES CO., LTD., Nagoya-shi, Aichi (JP)

(72) Inventor: Naruki Harada, Nagoya (JP)

(73) Assignee: MARUYASU INDUSTRIES CO., LTD., Nagoya-Shi, Aichi (JP)

( * ) Notice: Subject to any disclaimer, the term of this patent is extended or adjusted under 35 U.S.C. 154(b) by 56 days.

(21) Appl. No.: 14/741,986

(22) Filed: Jun. 17, 2015

(65) Prior Publication Data

US 2015/0369193 A1 Dec. 24, 2015

(30) Foreign Application Priority Data

Jun. 18, 2014 (JP) ..... 2014-125630
Apr. 14, 2015 (JP) ..... 2015-082470

(51) Int. Cl.
*F02M 55/00* (2006.01)
*F02M 55/02* (2006.01)
*F02M 63/02* (2006.01)

(52) U.S. Cl.
CPC ..... *F02M 55/025* (2013.01); *F02M 63/0225* (2013.01); *F02M 2200/856* (2013.01); *F02M 2200/857* (2013.01)

(58) Field of Classification Search
CPC ..... F02M 55/025; F02M 63/0225; F02M 2200/856; F02M 2200/857
See application file for complete search history.

(56) References Cited

U.S. PATENT DOCUMENTS 5,394,850 A * 3/1995 Murphy ..... F02M 35/10216 123/470
6,073,612 A * 6/2000 Ohkubo ..... F02M 55/025 123/456
7,347,190 B1 * 3/2008 Keegan ..... F02M 55/02 123/456
7,516,735 B1 * 4/2009 Doherty ..... F02M 55/005 123/468
9,038,603 B2 * 5/2015 Ikoma ..... F02M 55/025 123/470
9,422,903 B2 * 8/2016 Roseborsky ..... F02M 69/50
9,453,485 B2 * 9/2016 Masti ..... F02M 55/025
(Continued)

*Primary Examiner* — Hieu T Vo
*Assistant Examiner* — Sherman Manley
(74) *Attorney, Agent, or Firm* — Nixon & Vanderhye P.C.

(57) ABSTRACT

A fuel delivery pipe assembly for direct injection of fuel includes a fuel delivery pipe, a plurality of fuel injector sockets for containing a fuel injection valve, and a mounting bracket of sheet metal fixedly assembled with the fuel delivery pipe at a position adjacent each fuel injector socket. The mounting bracket has a mounting plate portion formed with a mounting hole for insertion of a bolt and a through hole for insertion of each fuel injector socket spaced from the mounting hole in the longitudinal direction of the delivery pipe. A reinforcement bracket is integrally assembled with the mounting bracket at the opposite side of the fuel injector socket in the longitudinal direction of the delivery pipe, and a reinforcement rib extended from an arm portion of the reinforcement bracket is provided on the mounting plate portion between the mounting hole and the through hole for the fuel injector socket.

5 Claims, 9 Drawing Sheets

(56) References Cited

U.S. PATENT DOCUMENTS

| | | | | |
|---|---|---|---|---|
| 2003/0213472 | A1* | 11/2003 | Suzuki | F02M 55/025 123/469 |
| 2006/0254563 | A1* | 11/2006 | Keegan | F02M 55/02 123/456 |
| 2009/0145504 | A1* | 6/2009 | Colletti | F02M 55/025 138/89 |
| 2010/0300409 | A1* | 12/2010 | Harvey | F02M 61/14 123/470 |
| 2011/0108005 | A1* | 5/2011 | Nishizawa | F02M 55/025 123/469 |
| 2013/0036607 | A1* | 2/2013 | Takasaki | F02M 55/025 29/888.01 |
| 2013/0125864 | A1* | 5/2013 | Kannan | F02M 61/168 123/469 |
| 2015/0136084 | A1* | 5/2015 | Maier | F02M 55/025 123/452 |
| 2016/0195054 | A1* | 7/2016 | Guengoer | F02M 63/0275 123/469 |

* cited by examiner

HIGH PRESSURE FUEL DELIVERY PIPE ASSEMBLY FOR DIRECT INJECTION OF FUEL

This application claims priority to JP Patent Application No. 2014-125630 filed 18 Jun. 2014 and JP Patent Application No. 2015-082470 filed Apr. 14, 2015, the entire contents of each of which are hereby incorporated by reference.

FIELD OF THE INVENTION

The present invention relates to a high pressure fuel delivery pipe assembly for direct injection of fuel into combustion chambers of multi-cylinder type engine.

BACKGROUND OF THE INVENTION

Disclosed in U.S. Patent Application Publication No. 2009/0145504 is a high pressure fuel delivery pipe assembly for direct injection of fuel of this kind. The high pressure fuel delivery pipe assembly includes a fuel distribution tube in the form of an elongate cylindrical conduit provided to form a fuel passage to be supplied with fuel under pressurized high pressure from a high pressure pump, four injector sockets formed to contain therein a fuel injection valve and integrally fixed to the conduit and, and four cylindrical mounting bosses having mounting holes for attachment of the conduit to an engine head. In the fuel delivery pipe assembly, the fuel injector sockets are applied with a reaction force caused by fuel injected from the fuel injection valves into each cylinder of the engine. To retain the fuel injector socket in place against the reaction force, the mounting bosses are fixedly assembled with the conduit in a position adjacent the respective fuel injector sockets.

As the mounting boss is manufactured by cut-machining, the manufacturing cost of the delivery pipe assembly is increased due to increase of the material cost and machining cost of the mounting bosses. Because the fuel injector sockets and mounting bosses are separately assembled with the conduit, it is very difficult to enhance positioning precision of the component parts. This causes a problem in the assembly process of the component parts to the engine head.

SUMMARY OF THE INVENTION

To overcome the problems, it is a primary object of the present invention to provide a high pressure fuel delivery pipe assembly capable of reducing the manufacturing cost and enhancing the mounting precision to the engine head.

According to the present invention, there is provided a high pressure fuel delivery pipe assembly for direct injection of fuel into internal combustion engines, comprising a fuel delivery pipe to be supplied with high pressure fuel from a fuel pump; a plurality of fuel injector sockets assembled with the fuel delivery pipe, the injector sockets each being formed with an internal cavity for containing a fuel injection valve; and a mounting bracket fixedly assembled with the fuel delivery pipe at a position adjacent each of the fuel injector sockets for mounting the fuel delivery pipe on an engine structure, wherein the mounting bracket is made of sheet metal and formed to have a mounting plate portion for engagement with the engine structure, the mounting plate portion being formed with a mounting hole for insertion of a bolt and a through hole for insertion of each of the fuel injector sockets spaced from the mounting hole in a longitudinal direction of the fuel delivery pipe, wherein the fuel injector sockets each are formed at its lower end with a outward radial flange that is fixed to a bottom surface of the mounting plate portion around the through hole for the fuel injector socket, and a fixture arm portion extending upward from one side of the mounting plate portion is fixedly assembled the fuel delivery pipe, wherein the mounting bracket is integrally assembled with a reinforcement bracket having a reinforcement arm portion located at the opposite side of the fuel injector socket in the longitudinal direction of the fuel delivery pipe and fixed at its opposite sides to the mounting plate portion and the fuel delivery pipe, and wherein the reinforcement bracket is provided with a reinforcement rib fixed to the upper surface of the mounting plate portion, said reinforcement rib extending from the reinforcement arm portion and located between the mounting hole and the through hole for the fuel injector socket.

In the high pressure fuel delivery pipe assembly described above, the mounting bracket made of sheet metal and formed by plastic working is useful to reduce the material and machining cost of the component parts. In the mounting bracket, a mounting hole for insertion of a mounting bolt and a through hole for insertion of the fuel injector socket are formed in the mounting plate portion of the bracket. This is useful to enhance positional precision of the fuel injector socket relative to the mounting hole and to facilitate mounting operation of the fuel delivery pipe assembly to the engine structure.

Although the fuel injector socket is applied with upward reaction force caused by injection of high pressure fuel from the fuel injection valve I, the upward reaction force is received by the mounting plate portion of the bracket since the outward radial flange formed on the lower end of fuel injector socket 20 is fixed at its upper surface to the bottom surface of the mounting plate portion around the through hole for the fuel injector socket. This is effective to restrain load acting on a portion of fuel injector socket 20 fixedly assembled with the fuel delivery conduit.

When the fuel delivery conduit is applied with vertical and lateral vibrations of the engine through the mounting bracket, the fixture portion of the mounting bracket to the fuel delivery conduit is applied with load caused by the vibrations.

To avoid a problem caused by the load, the arm portion of the mounting bracket extended upward from one side of the mounting plate portion and located at one side of the fuel injector socket is fixed to the upper and side portions of the fuel delivery pipe, and the arm portion of the reinforcement bracket is fixed to the fuel delivery pipe to reinforce the mounting plate portion located at the other side of the fuel injector socket. Thus, the mounting bracket is firmly secured to the fuel delivery pipe at both sides of the fuel injector socket by means of both the arm portions.

As the mounting hole of the bracket is spaced from the fuel injector socket in the longitudinal direction of the fuel delivery pipe, a fastening tool can be operated without being disturbed by the fuel injector socket to fasten a bolt inserted into the engine structure through the mounting hole. When the fuel injector socket tends to be inclined toward the center line of the mounting hole due to an upward reaction force acting thereon, such inclination of fuel injector socket is restrained since the bending stiffness of the mounting plate portion is enhanced by the stationary arm portion of the mounting bracket fixed to the fuel delivery pipe at one side of the fuel injector socket, the reinforcement arm portion of the bracket fixed to the fuel delivery pipe at the opposite side of the fuel injector socket and the reinforcement rib extending between the mounting hole and the through hole for the fuel injector socket. This is effective to decrease leakage of fuel from a sealing portion between the fuel injector socket and the fuel injection valve.

The reinforcement rib of the bracket has an extended portion partly enclosing the outer periphery of the fuel injector socket or extending to the fixture arm portion. The extended portion of the reinforcement rib is fixed to at least of the fuel injector socket and the fixture arm portion, the assemble of the reinforcement bracket and mounting bracket with the fuel delivery pipe is firmly reinforced.

The mounting plate may be provided with a stepped portion between the mounting hole and the through hole for the fuel injector socket to enhance the bending stiffness of the mounting plate portion thereby to restrain inclination of the fuel injector socket for avoiding leakage of fuel from the sealed of the fuel injection valve in the injector socket.

In the fuel delivery pipe assembly, the mounting brackets adjacent with each other may be integrally connected with each other by means of a connecting member to enhance stiffness of both the mounting plate portions thereby to decrease load acting on fixed parts of the mounting bracket and the fuel injector socket to the fuel delivery pipe.

BRIEF DESCRIPTION OF THE DRAWINGS

In the drawings:

FIG. 8(*b*) is a partly enlarged front view showing another modification wherein the mounting plate portion is stepped between the mounting hole and the through hole for the fuel injector socket;

PREFERRED EMBODIMENT OF THE PRESENT INVENTION

Hereinafter, preferred embodiments of a high pressure fuel delivery pipe assembly in accordance with the present invention will be described with reference to the accompanying drawings.

First Preferred Embodiment

Figure 1:
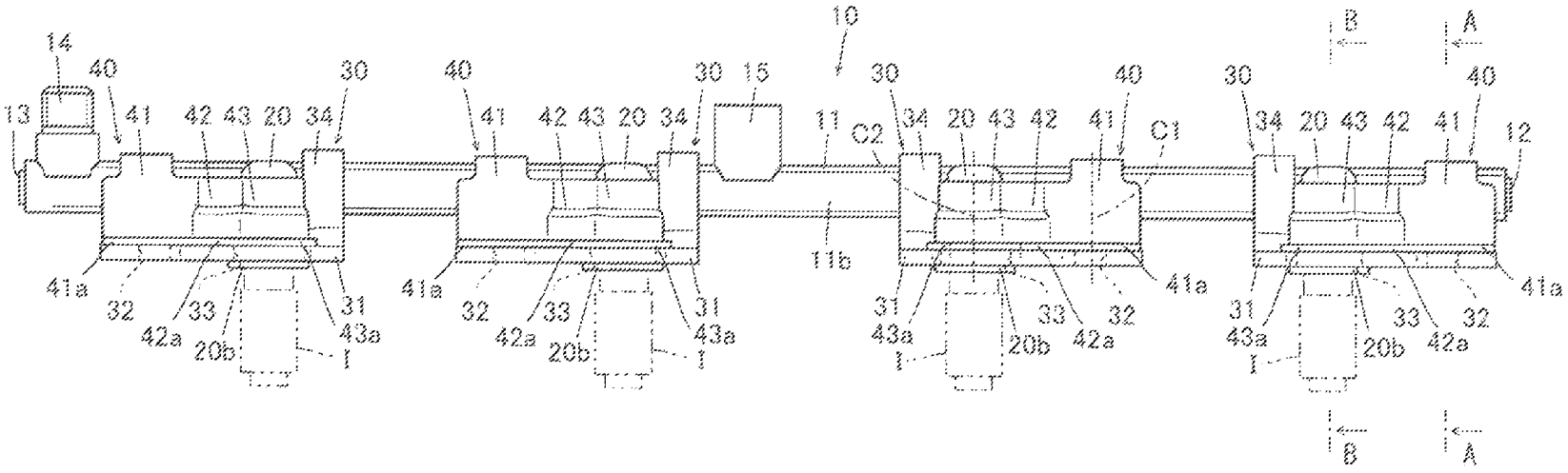
FIG. 1 is a front view of a first embodiment of a high pressure fuel delivery pipe assembly for direct injection engine in accordance with the present invention.
Figure 2:
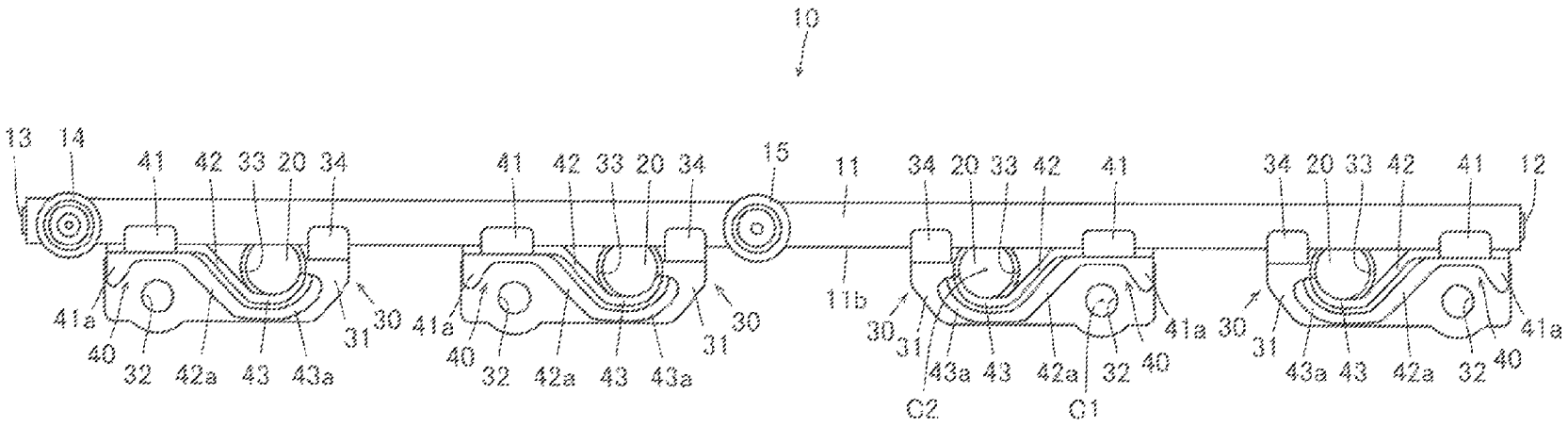
FIG. 2 is a plan view of the first embodiment shown in FIG. 1.
Figure 3:
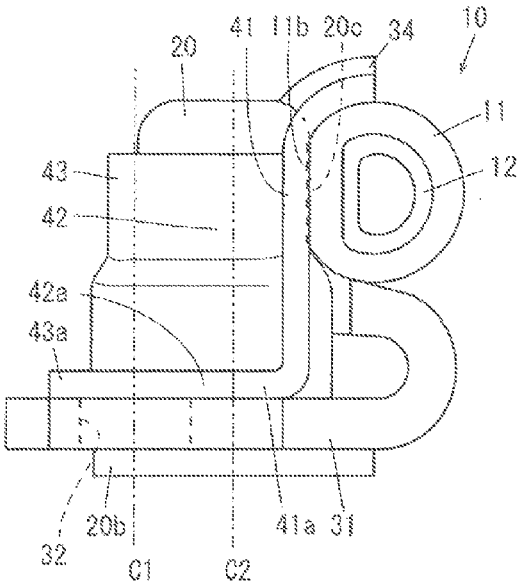
FIG. 3 is a right-side view of the first embodiment shown in FIG. 1.

A high pressure fuel delivery pipe assembly 10 in a first preferred embodiment of the present invention is adapted for use in a direct injection type engine of four series cylinders. As shown in FIGS. 1-3, the fuel delivery pipe assembly 10 includes a straight fuel delivery pipe 11 closed at its opposite ends with closure plugs 12, 13, four fuel injector sockets 20 each formed to contain a fuel injection valve in a fluid-tight manner and being integrally fixed to the fuel delivery pipe 11 at equally spaced positions, four mounting brackets 30 for mounting the fuel delivery pipe 11 on an engine head, reinforcement brackets 40 for reinforcing the fixture of mounting brackets 30 to the fuel delivery pipe 11, a joint member 14 fixed to the fuel delivery pipe 11 at its one end in a longitudinal direction, and a sensor mounting member 15 fixed to an approximately central portion of delivery pipe 11 in the longitudinal direction. These component parts are integrated in a brazing process and applied with surface treatment such as plating in necessity after the brazing process.

Figure 4:
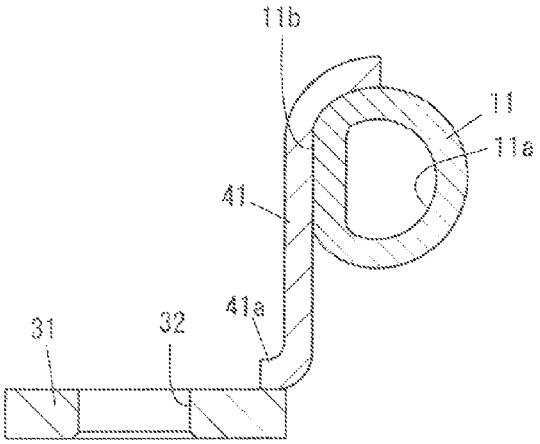
FIG. 4 is an end view of a section taken along a line A-A in FIG. 1.
Figure 5:
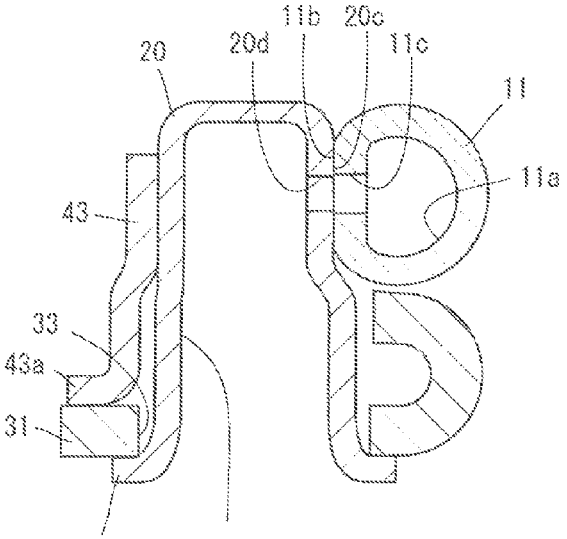
FIG. 5 is an end view of a section taken along a line B-B in FIG. 1
Figure 6:
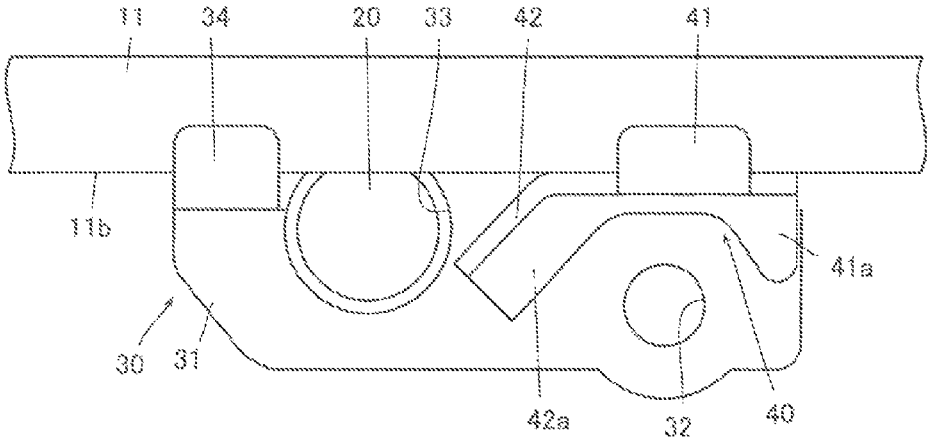
FIG. 6 is a partly enlarged plan view showing a modification of a reinforcement bracket.

The fuel delivery pipe 11 is made of sheet metal such as steel plate and is in the form of a straight pipe cut in a predetermined length. As shown in FIGS. 4 and 5, a fuel passage 11*a* is formed in a longitudinal direction within the fuel delivery pipe 11. As shown in FIGS. 3~5, the cross-section of delivery pipe 11 is formed in an approximate D-shape in cross-section by drawing formation or extrusion. As shown in FIG. 5, an elongate flat portion 11*b* of delivery pipe 11 is formed with through holes 11*c* corresponding with the number of fuel injection valves I to be mounted on the engine head. The through holes 11 are located in equally spaced positions at the same space between fuel injection valves I. These through holes 11*c* are communicated with through holes 20*d* formed across the peripheral wall of fuel injector socket 20 for fluid communication between the fuel passage 11*a* of delivery pipe 11 and the internal cavity of fuel injector socket 20. A fuel supply conduit (not shown) for supplying pressurized fuel from a high pressure fuel pump is connected to the joint member 14 by means of a union-nut (now shown) such that the pressurized fuel from the fuel pump is supplied to the fuel passage 11*a* in the delivery pipe 11. A pressure sensor (not shown) is mounted on the sensor mounting member 15 to detect the fuel pressure in fuel passage 11*a*. Although in this embodiment, the flat surface portion 11*b* of delivery pipe 11 is formed in the longitudinal direction, the delivery pipe 11 may be replaced with a straight pipe circular in cross-section formed with a flat portion only at positions of the fuel injector socket 20, the mounting bracket 30 and the reinforcement brackets 40.

As shown in FIGS. 1~3 and 5, the fuel injector socket 20 is made of pressed sheet metal and formed to have an upper closed cylindrical cavity 20*a* for containing the fuel injection valve I in a liquid tight manner. The fuel injector socket 20 is formed at its lower end with an outward radial flange 20*b*. The flat portion 20*c* is formed on an upper portion of fuel injector socket 20 opposed to the delivery pipe 11. As shown in FIG. 5, a through hole 20*d* formed in the flat portion 20*c* is communicated with the through hole 11*c* to provide a fluid communication between the fuel passage 11*a* of delivery pipe 11 and the internal cavity of fuel injector socket 20.

The mounting bracket 30 is provided for mounting the fuel delivery pipe 11 on the engine head and is assembled with the delivery pipe 11 at a position adjacent the fuel injector socket 20 as shown in FIGS. 1 and 2. The mounting bracket 30 is formed by press-forming of a sheet metal to have a mounting plate portion 31 extending in the longitudinal direction of delivery pipe 11 at the same height as the upper surface of radial flange 20*b* of fuel injector socket 20 and a fixture arm portion 34 extended to the upper surface of delivery pipe 11 from a one side of mounting plate portion 31. The mounting plate portion 31 has a mounting hole 32 through which a bolt is inserted for mounting the fuel delivery pipe 11 to the engine head and a through hole 33 through which the lower portion of fuel injector socket 20 is inserted at a position spaced from the mounting hole 32 in the longitudinal direction of delivery pipe 11. The peripheral portion of through hole 33 is secured at its bottom surface to the upper surface of outward radial flange 20*b* of fuel injector socket 20. As shown in FIGS. 1~3, the center line C1 of mounting hole 32 is apart from the center line C2 of fuel injector socket 20 in the longitudinal direction of delivery pipe 11 and spaced in a direction apart from the delivery pipe 11. This is useful to facilitate fastening operation of a bolt inserted into the mounting hole 32.

As shown in FIGS. 1~4, the arm portion 34 of mounting bracket 30 is positioned adjacent one side of fuel injector socket 20 and extended upward from the mounting plate portion 31 to enclose the upper surface of delivery pipe 11. The arm portion 34 is fixed to the flat surface 11*b* and the semi-circular upper surface of delivery pipe 11.

As shown in FIGS. 1 and 2, the mounting bracket 30 is assembled with a reinforcement bracket 40 for reinforcing fixture of the mounting bracket 30 to the delivery pipe 11. The reinforcement bracket 40 is formed by press-forming of a sheet metal to have a reinforcement arm portion 41 fixed to the delivery pipe 11 and mounting plate portion 31 and a reinforcement rib 42 for reinforcing the mounting plate portion 31. The reinforcement arm portion 41 is placed at opposite side relative to the fixture arm portion 34 of mounting bracket 30 in the longitudinal direction of delivery pipe 11. The reinforcement arm portion 41 has a flange portion 41*a* folded outward at its lower end and secured to an upper surface of the mounting plate portion 31 at one side of the delivery pipe 11, an intermediate portion 41*a* secured to the flat surface portion 11*b* and the upper portion of delivery pipe 11.

As shown in FIG. 2, the reinforcement rib 42 provided on the mounting plate portion 31 is extended from the reinforcement arm portion 41 laterally through a space between the mounting hole 32 and the through hole 33 for fuel injector socket 20 in the longitudinal direction of main conduit 11. The reinforcement rib 42 is placed in an upright condition between the mounting hole 32 and the through hole 33 and is secured to the upper surface of mounting plate portion 31 at its lower end flange 42*a*. The reinforcement rib 42 is useful to enhance rigidity of portions forming the mounting hole 32 and the through hole 33. In this embodiment, the reinforcement rib 42 is inclined in a direction apart from the delivery pipe 11 in accordance with approach to the fuel injector socket 20. In another embodiment, however, the end portion of reinforcement arm portion 41 may be bent perpendicularly in a direction apart from the delivery pipe 11 at a position between the mounting hole 32 and through hole 33 in such a manner that the reinforcement rib 42 extends in parallel with the delivery pipe 11. The reinforcement rib 42 may be also inclined in a direction approach to the delivery pipe 11 in accordance with approach to the fuel injector socket 20 in the longitudinal direction of pipe 11.

As shown in FIG. 2, the reinforcement rib 42 is inclined in a direction apart from delivery pipe 11 in accordance with approach to fuel injection valve socket 20 as described above. The reinforcement rib 42 has an extended portion 43 partly enclosing the outer periphery of fuel injection valve socket 20. The extended portion 43 is secured at its inner periphery to the outer periphery of fuel injection valve socket 20, and the flange portion 43*a* folded outward at the lower end of the extended portion 43 is fixed to the upper surface of mounting plate portion 31.

In a manufacturing process of the high pressure fuel delivery pipe for direct injection type engine, the fuel injector socket 20 is inserted through the through hole 33 of mounting plate portion 31 from its lower side and fixed at its lower end radial flange 20*b* to the bottom surface of the peripheral portion of through hole 33, as shown FIG. 3. Subsequently, as illustrated in FIG. 3, the reinforcement arm portion 41 of bracket 40, the reinforcement rib 42 and flange portions 41*a*, 42*a*, 43*a* of extended portion 43 are welded to the upper surface of mounting plate portion 31, and the extended portion 43 is welded at its periphery to a portion of fuel injector socket 20 to manufacture a sub-assembly of the fuel injector socket 20, mounting bracket 30 and reinforcement bracket 40. Thereafter, the closure plugs 12, 13 are connected to the opposite ends of delivery pipe 11, and the joint member 14 and sensor mounting member 15 are temporally welded in place to the delivery pipe 11. Similarly, the sub-assembly of fuel injector socket 20 and mounting bracket 30 is temporally welded to the delivery pipe 11 at a position where the through hole 11*c* of delivery pipe 11 is communicated with the through hole 20*d* of fuel injector socket 20. Thus, the above described component parts are assembled with the fuel delivery pipe 11 in a fluid-tight manner in a brazing process. In the sub-assembly of the component parts, it is to be noted that the flat surface portion 11*b* of delivery pipe 11 is fixed to the flat surface portion 20*c* of fuel injector socket 20 in a fluid-tight manner, and the fixture arm portion 34 and reinforcement arm portion 41 are fixed to the flat surface portion 11*b* and upper surface of delivery pipe 11.

In the high pressure fuel delivery pipe assembly 10 constructed as described above, the mounting bracket 30 and the reinforcement bracket 40 are provided by press-forming of a sheet metal to restrain manufacturing cost of the fuel delivery pipe assembly. As the mounting hole 32 and the through hole 33 are formed in the mounting plate portion 31 of bracket 30, the fuel injector socket 20 inserted through the through hole 33 is accurately positioned relative to the mounting hole 32. This is effective to enhance mounting precision of the fuel delivery pipe assembly.

When the fuel injector socket 20 is applied with upward reaction force caused by injection of high pressure fuel from the fuel injection valve I, the upward reaction force is received by the mounting plate portion 31 of bracket 30 since the outward flange 20*b* formed on the lower end periphery of fuel injector socket 20 is secured at its upper surface to the peripheral portion of through hole 33 of mounting plate portion 31. This is effective to restrain load acting on a portion of fuel injector socket 20 fixed to the main conduit 11.

When the delivery pipe 11 is applied with vibration of the engine in vertical and lateral directions through the mounting bracket 30, the fixed portion of the mounting bracket 30 and delivery pipe 11 is applied with load caused by the vibration. To restrain the load acting on the mounting bracket 30, the fixture arm portion 34 of mounting bracket 30 located at one side of the fuel injector socket 20 is brazed to the upper surface and flat side surface of delivery pipe 11, and the mounting plate portion 31 of bracket 30 is fixed to the delivery pipe 11 by means of the reinforcement arm portion 41 of bracket 40 located opposite side of arm portion 34 of fuel injector socket 20. With such arrangement, the delivery pipe 11 and the mounting bracket 30 are reinforced by the mounting bracket 40. Thus, the mounting bracket 30 is firmly fixed to the fuel delivery pipe at opposite sides of the fuel injector socket 20 11 by means of the fixture arm portion 34 and the reinforcement arm portion 41 to restrain the load acting on the fixed portion of mounting bracket 30 and delivery pipe 11.

In the mounting bracket 30, the through hole 33 for fuel injector socket 20 is spaced from the mounting hole 32 in the longitudinal direction of delivery pipe 11, and the center line C1 of mounting hole 32 is offset to the center line C2 of fuel injector socket 20 in a lateral direction across the longitudinal direction of the delivery pipe 11. With such arrangement, a fastening tool can be operated without being disturbed by the fuel injector socket 20 to fasten a bolt inserted into the engine structure through the mounting hole 32. When the fuel injector socket 20 tends to be inclined toward the center line C1 of mounting hole 32 due to an upward reaction force acting thereon, such inclination of fuel injector socket 20 is restrained since the bending stiffness of mounting plate portion 31 is enhanced by the fixture arm portion 34 of mounting bracket 30 secured to the delivery pipe 11 at one side of the fuel injector socket 20, the reinforcement arm portion of bracket 40 secured to the delivery pipe 11 at the opposite side of fuel injector socket 20 and the reinforcement rib 42 extending between the mounting hole 32 and the through hole 33. This is effective to decrease leakage of fuel from a sealing portion between the fuel injector socket 20 and fuel injection valve I.

Figure 7:
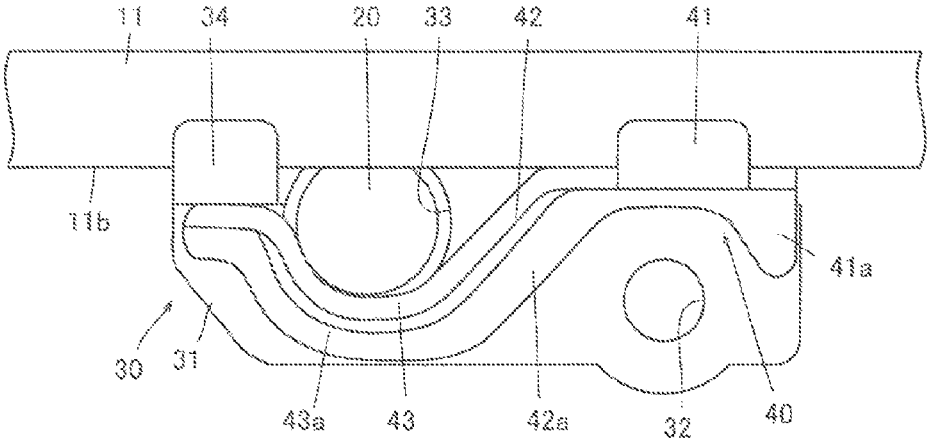
FIG. 7 is a partly enlarged plan view showing a modification of the reinforcement bracket with an extended portion extending to a fixture arm portion.

As shown in FIGS. 1 and 2, the reinforcement rib 42 of bracket 40 has an extended portion 43 partly enclosing the outer periphery of fuel injector socket 20. The extended portion 43 of rib 42 is secured to the outer periphery of fuel injector socket 20 to enhance reinforcement of the fixed portion of fuel injector socket 20 and mounting bracket 30 to the delivery pipe 11. In a modification shown in FIG. 7, the extended portion 43 of reinforcement rib 42 is further extended from the outer periphery of fuel injector socket 20 to the arm portion 34 of mounting bracket 30 and fixed at its inner periphery to the fuel injector socket 20 and the arm portion 34 of mounting bracket 30. In this modification, the reinforcement bracket 40 is useful to further firmly reinforce the fixture of the fuel injector socket 20 and mounting bracket 30 to the fuel delivery pipe 11.

Figure 8A:
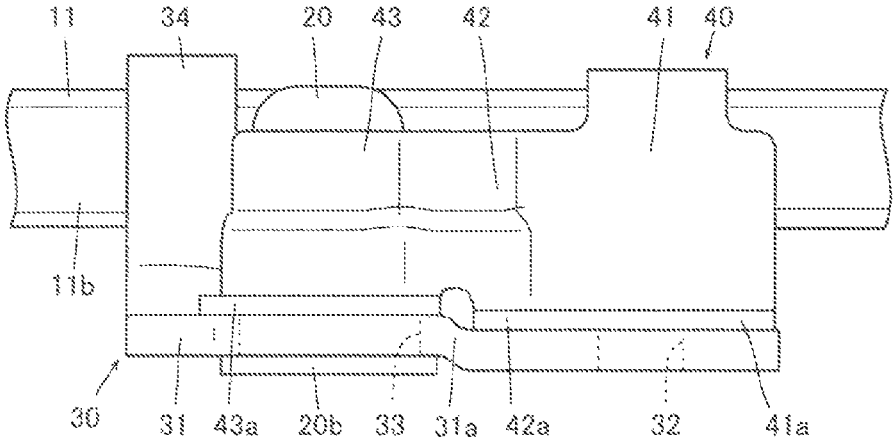
FIG. 8(*a*) is a partly enlarged front view showing a modification wherein the mounting plate portion is stepped between a mounting hole and a through hole for a fuel injector socket.
Figure 8B:
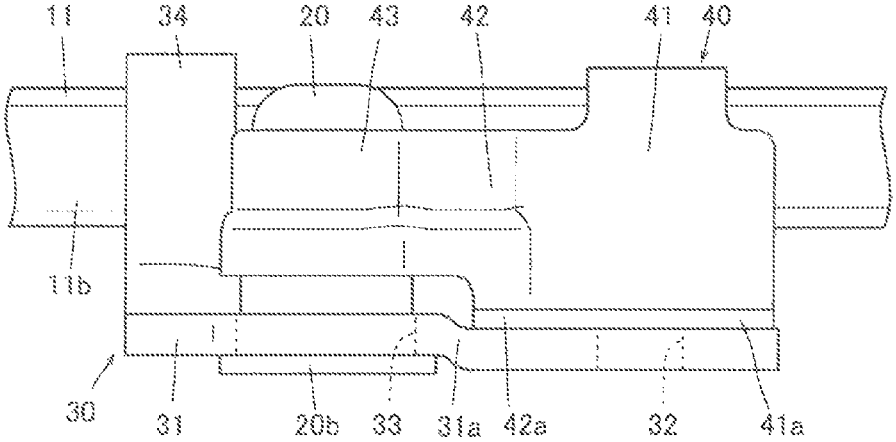

Disclosed in FIG. 8 (*a*), (*b*) is a modification of the mounting plate portion 31 of bracket 30, wherein a stepped portion 31*a* is provided between the portion formed with the mounting hole 32 and the portion formed with the through hole 33 for fuel injector socket 20. The stepped portion 31*a* is formed in a direction perpendicular to the delivery pipe 11 to enhance the bending stiffness of mounting plate portion 31. With such arrangement of the stepped portion 31*a*, inclination of the fuel injector socket 20 toward the center line C1 of mounting hole 32 is restrained to avoid leakage of fuel from the sealed portion of the fuel injection valve I in the injector socket. In another modification, as shown in FIG. 8(*a*), the extended portion 43 of reinforcement bracket 40 may be fixed at its lower flange 43*a* to the upper surface of mounting plate portion 31 or as shown in FIG. 8(*b*), the lower end of extended portion 43 may be spaced from the upper surface of mounting plate portion 31 without providing the lower end flange 43*a*.

Second Embodiment

Figure 9:
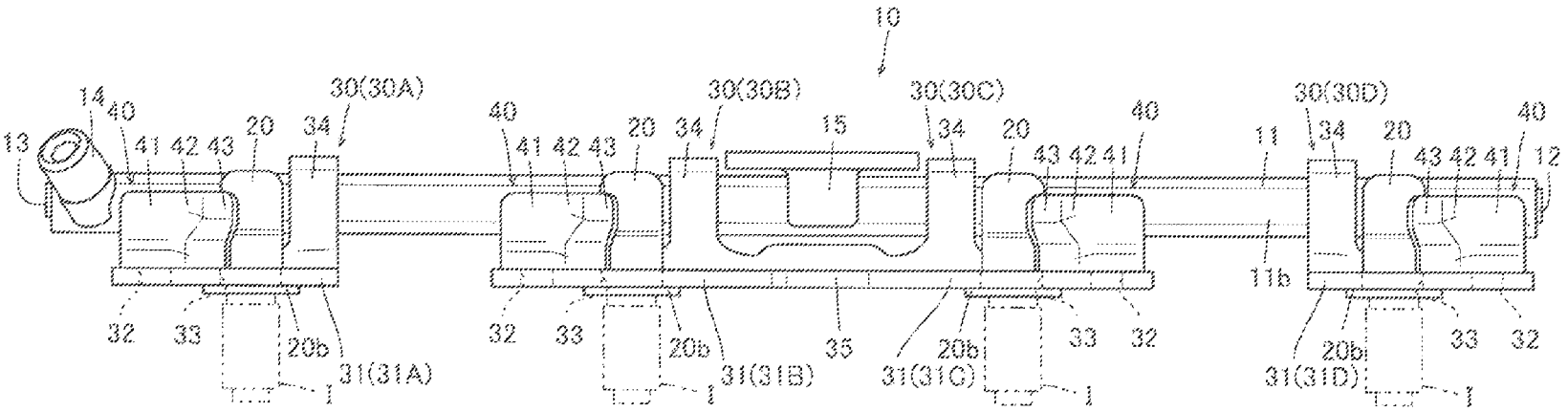
FIG. 9 is a front view of a second embodiment of a high pressure fuel delivery pipe assembly in accordance with the present invention.
Figure 10:
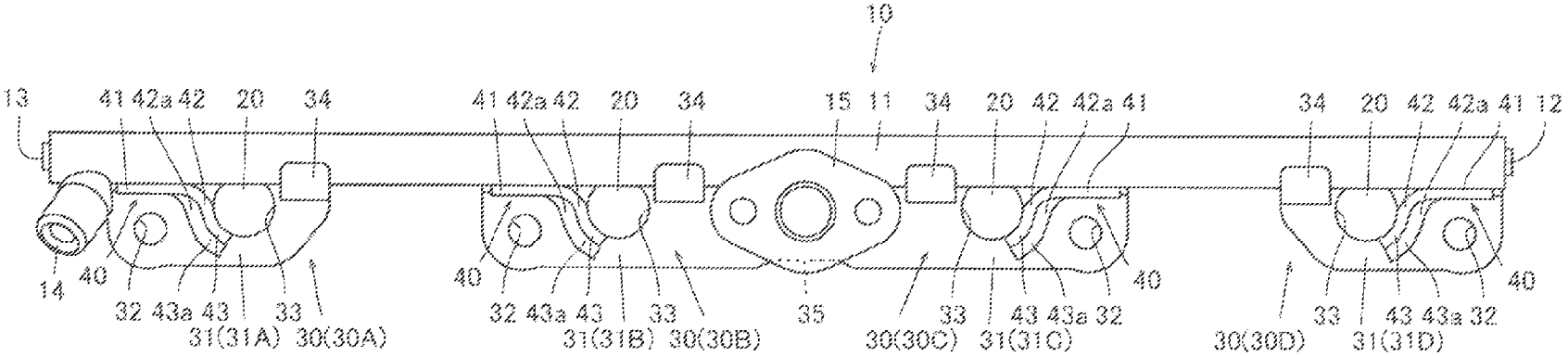
FIG. 10 is a plan view of the second embodiment shown in FIG. 9.

In FIGS. 9 and 10, there is illustrated a second embodiment of the present invention, wherein the mounting bracket 30 and reinforcement bracket 40 are changed in construction. In this second embodiment, the mounting plate portions 31 (31B, 31C) of the two mounting brackets 30 (30B, 30C) assembled with the central portion of fuel delivery pipe 11 are integrally connected with each other by means of a joint member 35. The mounting plate portions 31B, 31C of the two brackets 30B, 30C are formed by press machining of a sheet metal to be connected with each other by the joint member 35.

As in the first embodiment of the present invention, the reinforcement bracket 40 is formed by press machining of a sheet metal to have a reinforcement arm portion fixed to the delivery pipe 11 and mounting plate portion 31 of bracket 30, a reinforcement rib 42 of mounting plate portion 31, and an extended portion 43 extending from an end of reinforcement rib 42 to partly enclose the outer periphery of fuel injector socket 20. In this second embodiment, the reinforcement arm portion 41 of bracket 40 is fixed only to the flat plate portion 11*b* of delivery pipe 11 and is fixed at its lower end to the mounting plate portion 31 of bracket 30 without the lower end flange 41*a* shown in FIG. 3. The other component parts and construction are substantially the same as those in the first embodiment.

When fuel under high pressure is ejected from each fuel injection valve I in the fuel delivery pipe assembly mounted on an engine head, it is assumed that each mounting plate portion of the brackets 30 is applied with upward load in different directions caused by upward reaction forces in different directions. In such an instance, the stiffness of both the mounting plate portions enhanced by the joint member 35 is effective to restrain vertical displacement amount of the fuel injection valves thereby to decrease load acting on the fixed portion of mounting bracket 30 to delivery pipe 11 and the fixed portion of reinforcement bracket to delivery pipe 11. When a bolt is inserted through the mounting hole 32 of one-hand mounting plate portion (31B or 31C) and fastened for mounting one-hand mounting bracket (30B or 30C) to the engine structure, the other-hand mounting plate portion tends to be displaced in a vertical direction. In such an instance, the joint member 35*b* integrally formed between both the mounting plate portions 31(31B, 31C) is effective to restrain vertical displacement of the mounting plate portion in a free condition. This is useful to decrease load acting on the fixed portion of mounting bracket 30 and delivery pipe 11 and the fixed portion of reinforcement bracket 40 and delivery pipe 11.

Although in the embodiment shown in FIG. 9, the joint member 35 is integrally formed with both the mounting plate portions 31(31B, 31C), the joint member 35 may be provided to integrally joint both the mounting plate portions (31A, 31B; or 31C, 31D) adjacent with each other or to integrally joint all the mounting plate portions.

Figure 11:
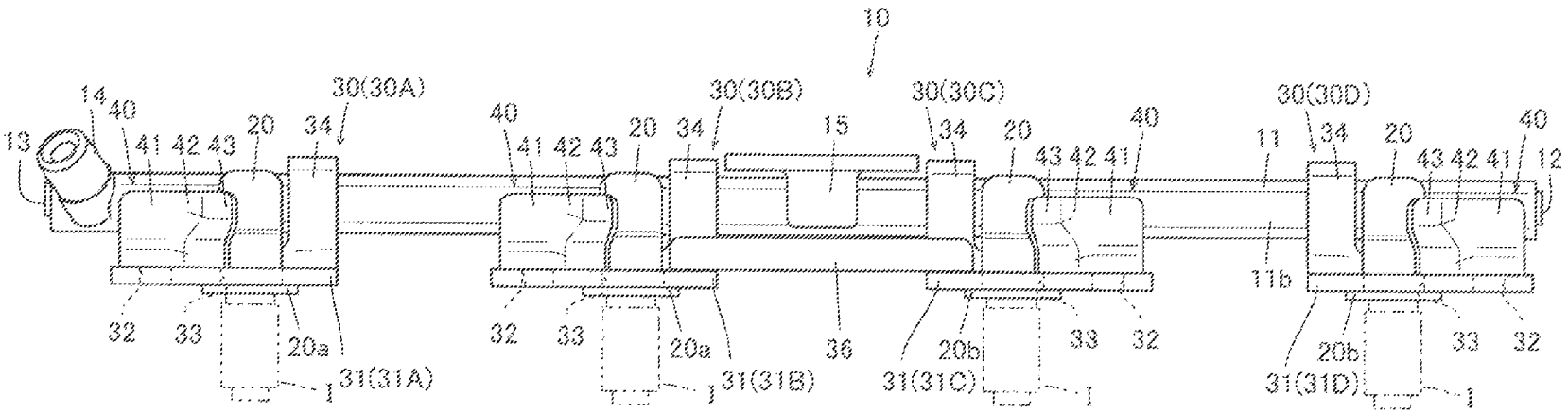
FIG. 11 is a front view of a modification of the second embodiment.
Figure 12:
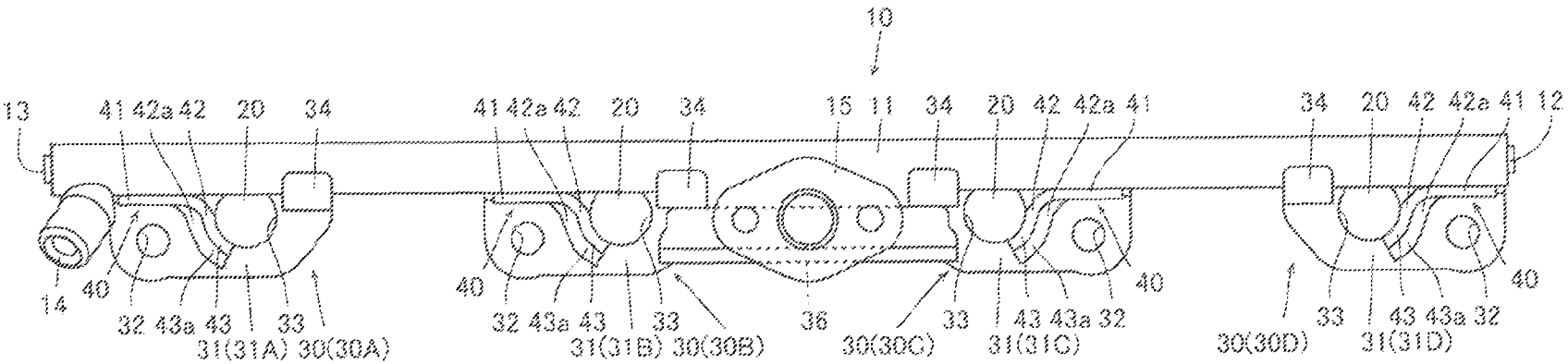
FIG. 12 is a plan view of the modification shown in FIG. 11.

Disclosed in FIGS. 11 and 12 is another modification wherein the mounting plate portions (31B, 31C) of both brackets 30 are connected with each other by a connecting member 36 of L-letter shape in cross-section. The connecting member 36 is made of sheet metal and formed by press-machining, protrusion molding or extrusion. The connecting member 36 may be replaced with a metallic flat plate, a metallic pipe or a metallic solid rod. The connecting member 36 is fixed to an upper surface or a bottom surface of the respective mounting portions 31 at its opposite ends.

Although in each embodiment described above, the fuel injector socket 20 is fixed to the side surface of delivery pipe 11, the top surface of fuel injector socket 20 may be fixed to the bottom surface of delivery pipe 11. In another practical embodiment, the fixture arm portion 34 of mounting bracket 30 may be provided at left-side or right-side of the fuel injector socket 20. Similarly, the reinforcement arm portion 41 of bracket 40 may be provided at left-side or right-side of the fuel injector socket 20 located at opposite side of the arm portion 34 of mounting bracket 30.

What is claimed is:

1. A high pressure fuel delivery pipe assembly for direct injection of fuel into internal combustion engines, comprising a fuel delivery pipe to be supplied with high pressure fuel from a fuel pump; a plurality of fuel injector sockets assembled with the fuel delivery pipe, the injector sockets each being formed with an internal cavity for containing a fuel injection valve; and a mounting bracket fixedly assembled with the fuel delivery pipe at a position adjacent each of the fuel injector sockets for mounting the fuel delivery pipe on an engine structure, wherein the mounting bracket is made of sheet metal and formed to have a mounting plate portion for engagement with the engine structure, the mounting plate portion being formed with a mounting hole for insertion of a bolt and a through hole for insertion of each of the fuel injector sockets spaced from the mounting hole in a longitudinal direction of the fuel delivery pipe, wherein the fuel injector sockets each are formed at its lower end with an outward radial flange that is fixed to a bottom surface of the mounting plate portion around the through hole for the fuel injector socket, and a fixture arm portion extending upward from one side of the mounting plate portion is fixedly assembled with the fuel delivery pipe, wherein the mounting bracket is integrally assembled with a reinforcement bracket having a reinforcement arm portion located at the opposite side of the fuel injector socket in the longitudinal direction of the fuel delivery pipe and fixed at its opposite sides to the mounting plate portion and the fuel delivery pipe, and wherein the reinforcement bracket is provided with a reinforcement rib fixed to the upper surface of the mounting plate portion, said reinforcement rib extending from the reinforcement arm portion and located between the mounting hole and the through hole for the fuel injector socket.

2. A high pressure fuel delivery pipe assembly as claimed in claim 1, wherein said reinforcement rib has an extended portion partly enclosing the outer periphery of said fuel injector socket or extending to the fixture arm portion of said mounting bracket, the extended portion of said reinforcement rib being fixed at least to the outer periphery of said fuel injector socket and the fixture arm portion of said mounting bracket.

3. A high pressure fuel delivery pipe assembly as claimed in claim 1, wherein the mounting plate portion of said mounting bracket is stepped transversely at a position between the mounting hole and the through hole for said fuel injector socket in the longitudinal direction of the delivery pipe.

4. A high pressure fuel delivery pipe assembly as claimed in claim 1, wherein the mounting plate portions adjacent to each other in the longitudinal direction of said fuel delivery pipe are jointed by a joint member.

5. A high pressure fuel delivery pipe assembly as claimed in claim 1, wherein the mounting plate portions adjacent to each other in the longitudinal direction of said fuel deliver pipe are connected by a connecting member.

* * * * *